US012403381B2

(12) United States Patent
Dagneau et al.

(10) Patent No.: US 12,403,381 B2
(45) Date of Patent: Sep. 2, 2025

(54) HOCKEY GOALTENDER LEG PADS

(71) Applicant: SPORT MASKA INC., Montreal (CA)

(72) Inventors: François-Olivier Dagneau, Dorval (CA); Francis Ouellet, Montréal (CA)

(73) Assignee: SPORT MASKA INC.

( * ) Notice: Subject to any disclaimer, the term of this patent is extended or adjusted under 35 U.S.C. 154(b) by 0 days.

(21) Appl. No.: 17/682,453

(22) Filed: Feb. 28, 2022

(65) Prior Publication Data

US 2022/0280861 A1 Sep. 8, 2022

Related U.S. Application Data

(60) Provisional application No. 63/155,352, filed on Mar. 2, 2021.

(51) Int. Cl.
*A63B 71/12* (2006.01)
*A63B 102/24* (2015.01)

(52) U.S. Cl.
CPC .... *A63B 71/1225* (2013.01); *A63B 2071/125* (2013.01); *A63B 2071/1258* (2013.01); *A63B 2071/1283* (2013.01); *A63B 2102/24* (2015.10)

(58) Field of Classification Search
CPC ..... A63B 2102/22; A63B 2071/1275; A63B 2102/24; A63B 2071/1258; A63B 71/1225; A41D 13/065
USPC ..... 2/22
See application file for complete search history.

(56) References Cited

U.S. PATENT DOCUMENTS

| | | | | | |
|---|---|---|---|---|---|
| 5,000,195 | A * | 3/1991 | Neal | A61F 5/0111 | 602/27 |
| 5,093,931 | A * | 3/1992 | LaBerge | A63B 71/1225 | 2/22 |
| 7,691,076 | B2 * | 4/2010 | Castro | A61F 5/0127 | 128/882 |
| 8,161,569 | B2 * | 4/2012 | Hudon | A63B 71/1225 | 2/22 |
| 9,211,461 | B2 * | 12/2015 | Marciano | A63B 71/14 | |
| 9,352,531 | B2 * | 5/2016 | Berns | B32B 5/245 | |
| D806,955 | S * | 1/2018 | Gosselin | D29/116.3 | |
| 9,962,594 | B2 * | 5/2018 | Ramirez | A41D 19/01564 | |
| 10,524,936 | B2 * | 1/2020 | Barberio | A61F 2/80 | |
| 10,905,179 | B2 * | 2/2021 | Epperson | A41D 13/0518 | |
| 2005/0015841 | A1 * | 1/2005 | Hoffman | A41D 13/05 | 2/22 |
| 2007/0250965 | A1 * | 10/2007 | Sioul | B32B 3/28 | 2/24 |

(Continued)

*Primary Examiner* — Grace Huang
(74) *Attorney, Agent, or Firm* — NORTON ROSE FULBRIGHT CANADA

(57) ABSTRACT

A hockey goalkeeper leg pad with a top end and a bottom end, having: an outer shell having a facing section, a rear section, a lateral section, and a medial section, the medial section located inwardly of the lateral section when worn by the wearer, the facing, rear, lateral, and medial sections interconnected to form a pocket defined within the outer shell; a core padding received within the pocket of the outer shell; and a medial pad secured to the medial section of the outer shell, the medial pad having a longitudinal pad extending longitudinally between the top end and the bottom end, and a knee pad monolithically protruding from the longitudinal pad in a transverse direction, a width of the medial pad extending uninterrupted from a front edge of the longitudinal pad to a rear edge of the knee pad.

11 Claims, 12 Drawing Sheets

(56) References Cited

U.S. PATENT DOCUMENTS

| | | | | |
|---|---|---|---|---|
| 2013/0318675 | A1* | 12/2013 | Mackey | A63B 71/1225 2/22 |
| 2015/0128325 | A1* | 5/2015 | Vaughn | A63B 71/1225 2/22 |
| 2020/0070035 | A1* | 3/2020 | Vaillancourt | A63B 71/1225 |

* cited by examiner

HOCKEY GOALTENDER LEG PADS

CROSS-REFERENCE

This application claims priority on U.S. Patent Application No. 63/155,352 filed Mar. 2, 2021, the entire content of which is incorporated by reference herein.

TECHNICAL FIELD

The present disclosure relates generally to protective sports equipment and, more particularly, to ice hockey goalkeeper pads.

BACKGROUND

Ice hockey players generally wear protective leg equipment. Ice hockey goalkeepers (goaltenders) wear a specific type of leg pad, typically referred to simply as "goalie pads". Improvements in such goalie leg pads are continuously sought, particularly in order to improve the comfort, performance and/or mobility of the goalkeeper.

SUMMARY

In one aspect, there is provided a hockey goalkeeper leg pad having a top end proximate a knee of a wearer and a bottom end proximate a foot of the wearer, hockey goalkeeper leg pad comprising: an outer shell having a facing section facing away from the wearer, a rear section facing the wearer, a lateral section, and a medial section, the medial section located inwardly of the lateral section when worn by the wearer, the facing, rear, lateral, and medial sections interconnected to form a pocket defined within the outer shell; a core padding received within the pocket of the outer shell; and a medial pad secured to the medial section of the outer shell, the medial pad having a longitudinal pad extending longitudinally between the top end and the bottom end, and a knee pad monolithically protruding from the longitudinal pad in a transverse direction, a width of the medial pad extending uninterrupted from a front edge of the longitudinal pad to a rear edge of the knee pad.

The hockey goalkeeper leg pad may include any of the following features, in whole or in part, and in any combination.

In some embodiments, the medial pad is free of a hinge connection at an intersection between the knee pad and the longitudinal pad, the knee pad being substantially non-rotatable relative to the longitudinal pad.

In some embodiments, the knee pad and the longitudinal pad are free of a stitch line therebetween.

In some embodiments, a thickness of the medial pad in a direction transverse to the width is uniform from the longitudinal pad to the knee pad across an intersection therebetween.

In some embodiments, a medial edge of the rear section is stitched to a rear edge of the medial section along a stitch line, the stitch line extending around the knee pad.

In some embodiments, the medial section of the outer shell is free of direct connection to the rear section of the outer shell along an intersection between the longitudinal pad and the knee pad.

In some embodiments, the pocket has a core volume receiving the core padding, a knee pad volume receiving the knee pad, and a longitudinal pad volume receiving the longitudinal pad, the knee pad volume uninterruptedly communicating with the longitudinal pad volume for receiving a monolithic body defining the knee pad and the longitudinal pad.

In some embodiments, the facing section has a front lateral edge, the rear section has a rear lateral edge, the lateral section has opposed front and rear lateral edges each secured to a respective one of the front lateral edge and the rear lateral edge via one or more stitch lines, the front lateral edge, the rear lateral edge, and the opposed front and rear lateral edges located inside the pocket.

In some embodiments, the facing section has a front medial edge, the rear section has a rear medial edge, and the medial section has opposed front and rear medial edges each secured to a respective one of the front medial edge and the rear medial edge, the front medial edge, the rear medial edge, and the opposed front and rear medial edges located outside the pocket.

In some embodiments, the opposed front and rear medial edges follow a contour of the knee pad.

In another aspect, there is provided hockey goalkeeper leg pad having a top end proximate a knee of a wearer and a bottom end proximate a foot of the wearer, the hockey goalkeeper leg pad comprising: a plurality of sections including a facing section facing away from the wearer, a lateral section, a medial section, and a rear section facing toward the wearer, the plurality of sections being interconnected to define a pocket sized for receiving a core padding of the hockey goalkeeper leg pad; and a medial pad as the medial section of the outer shell, the medial pad having a longitudinal pad extending longitudinally between the top end and the bottom end, and a knee pad monolithic with the longitudinal pad and protruding therefrom in a transverse direction, a thickness of the medial pad being substantially constant from the longitudinal pad to the knee pad across an intersection between the longitudinal pad and the knee pad such that the knee pad is substantially non-rotatable relative to the longitudinal pad.

The outer shell may include any of the following features, in any combinations.

In some embodiments, the knee pad and the longitudinal pad are free of a stitch line therebetween.

In some embodiments, the pocket has a core volume sized for receiving the core padding, a knee pad volume receiving the knee pad, and a longitudinal pad volume receiving the longitudinal pad, the knee pad volume uninterruptedly communicating with the longitudinal pad volume for receiving a monolithic body defining the knee pad and the longitudinal pad.

In yet another aspect, there is provided a method of manufacturing a hockey goalkeeper leg pad, comprising: obtaining an outer shell defining a pocket, the outer shell having a facing section, a rear section, a medial section, and a lateral section; securing a medial pad to the medial section of the outer shell, the medial pad having a longitudinal pad and a knee pad, the longitudinal pad extending longitudinally between a top end and a bottom end, the knee pad monolithically protruding from the longitudinal pad in a transverse direction; inserting a core padding inside the pocket of the outer shell; and closing an opening of the pocket by securing a rear edge of the medial section of the outer shell to a medial edge of the rear section of the outer shell by contouring a perimeter of the knee pad such that a thickness of the medial pad at an intersection between the knee pad and the longitudinal pad is substantially equal to the thickness of the medial pad at opposite sides of the intersection.

The method may include any of the following features, in any combinations.

In some embodiments, the closing of the pocket includes enclosing the knee pad between a protrusion of the rear section of the outer shell and a protrusion of the medial section of the outer shell such that the medial section of the outer shell is free of direct connection to the rear section at the intersection between the longitudinal pad and the knee pad.

In some embodiments, the obtaining of the outer shell includes securing together top edges and bottom edges of the facing section and the rear section.

In some embodiments, the method includes orienting outer faces of the facing section and of the rear section toward one another before the securing together of the top edges and the bottom edges of the facing section and of the rear section.

In some embodiments, the method includes flipping the outer shell inside out until inner faces of the facing section and of the rear section face one another.

In some embodiments, the method includes securing a lateral edge of the rear section to an edge of the lateral section before the flipping of the outer shell inside out such that the top edges, the bottom edges, the lateral edge of the rear section, and the edge of the lateral section are located inside the pocket.

In some embodiments, the outer shell defines a core volume receiving the core padding, a knee volume, and a longitudinal volume, the method comprising inserting the knee pad inside the knee volume and inserting the longitudinal pad inside the longitudinal volume.

Many further features and combinations thereof concerning the present improvements will appear to those skilled in the art following a reading of the instant disclosure.

DETAILED DESCRIPTION

Figure 1:
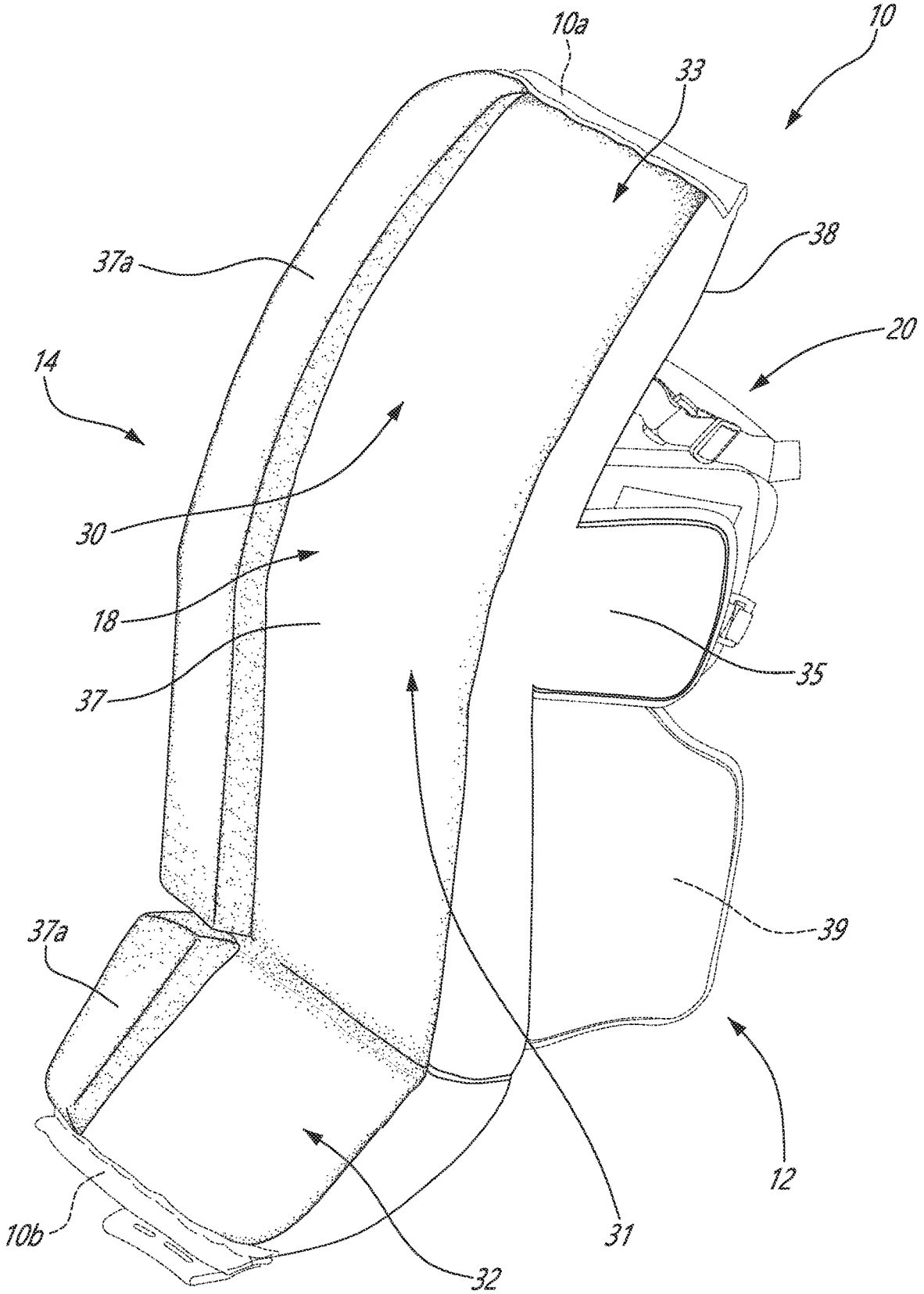
FIG. 1 is a front perspective view of a right hockey goalkeeper leg pad in accordance with an embodiment of the present disclosure.

Referring to FIGS. 1-5, the ice hockey (or simply "hockey") goalkeeper leg pad 10 is adapted to be worn a goalkeeper to protect at least a portion of a leg of the goalkeeper. The hockey goalkeeper leg pad 10 (also referred to herein simply as "leg pad 10" herein below) can have different sizes and shapes and is adapted to cover, or substantially cover, the leg. In the depicted embodiment, the leg pad 10 is of a type generally known as a "goalie pad" or a "goalkeeper's pad" such as those worn by ice hockey goalkeepers. The leg pad 10 extends between an upper end 10*a* and a lower end 10*b* thereof. The upper end 10*a* extends above a knee of the wearer and typically cover a portion of a thigh of the wearer. The lower end 10*b* typically covers a foot of the wearer.

When the leg pad 10 is worn by the player (wearer), it extends along the leg from a skate worn by the wearer to a thigh of the wearer. In the embodiment shown, the leg pad 10 is adapted to be worn on the right leg of the wearer. A corresponding leg pad, which may be a mirror image of the leg pad 10, may be worn on the left leg of the wearer. FIGS. 1-6*a* describe the leg pad 10, which is designed to be worn over a left leg of a wearer, whereas FIGS. 7-12 describe a right leg pad, which is a mirror image of the leg pad 10 of FIG. 1.

The leg pad 10 has a medial side 12 and an opposed lateral side 14. The leg pad 10 has an inner side 16 (FIG. 3) facing toward the leg of the wearer and an opposed outer side 18 facing away from the wearer. When both of the left and right leg pads are worn, on the left and right legs of the wearer respectively, the medial sides 12 are facing one another and the lateral sides 14 are facing away from one another. The medial sides 12 may therefore be located proximate medial portions of the legs of the wearer. In the embodiment shown, the leg pad 10 includes inner paddings 20 (FIG. 3) located on the inner side 16 of the leg pad 10 and an outer padding 30 (FIG. 2) defining the outer side 18 of the leg pad 10. The inner paddings 20 are secured to the outer padding 30 as will be explained below. The leg pad 10 may be secured to the leg of the wearer via the inner paddings 20 and/or suitable attachment means such as straps or buckles.

Figure 3:
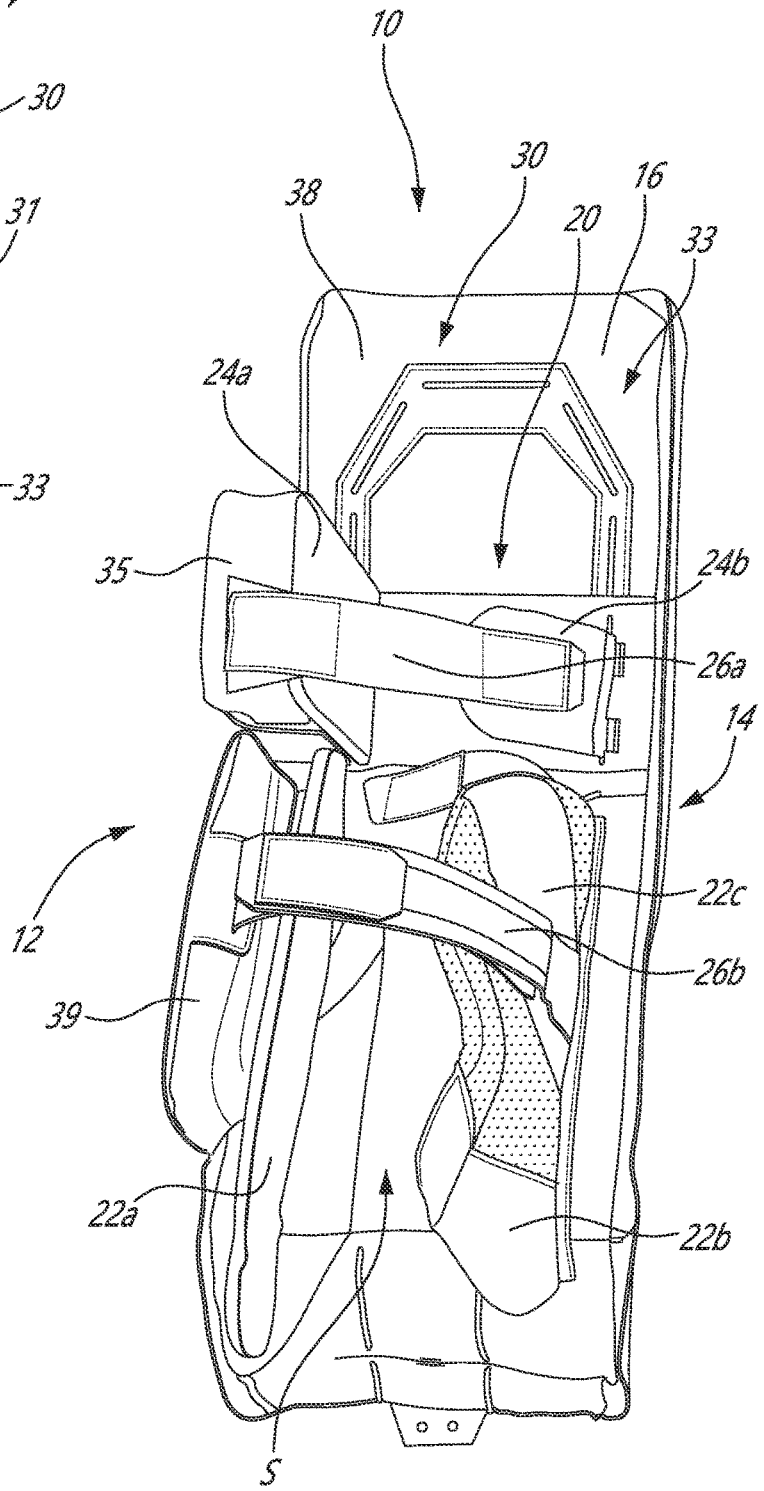
FIG. 3 is a rear view of the right leg pad of FIG. 1.
Figure 3B:
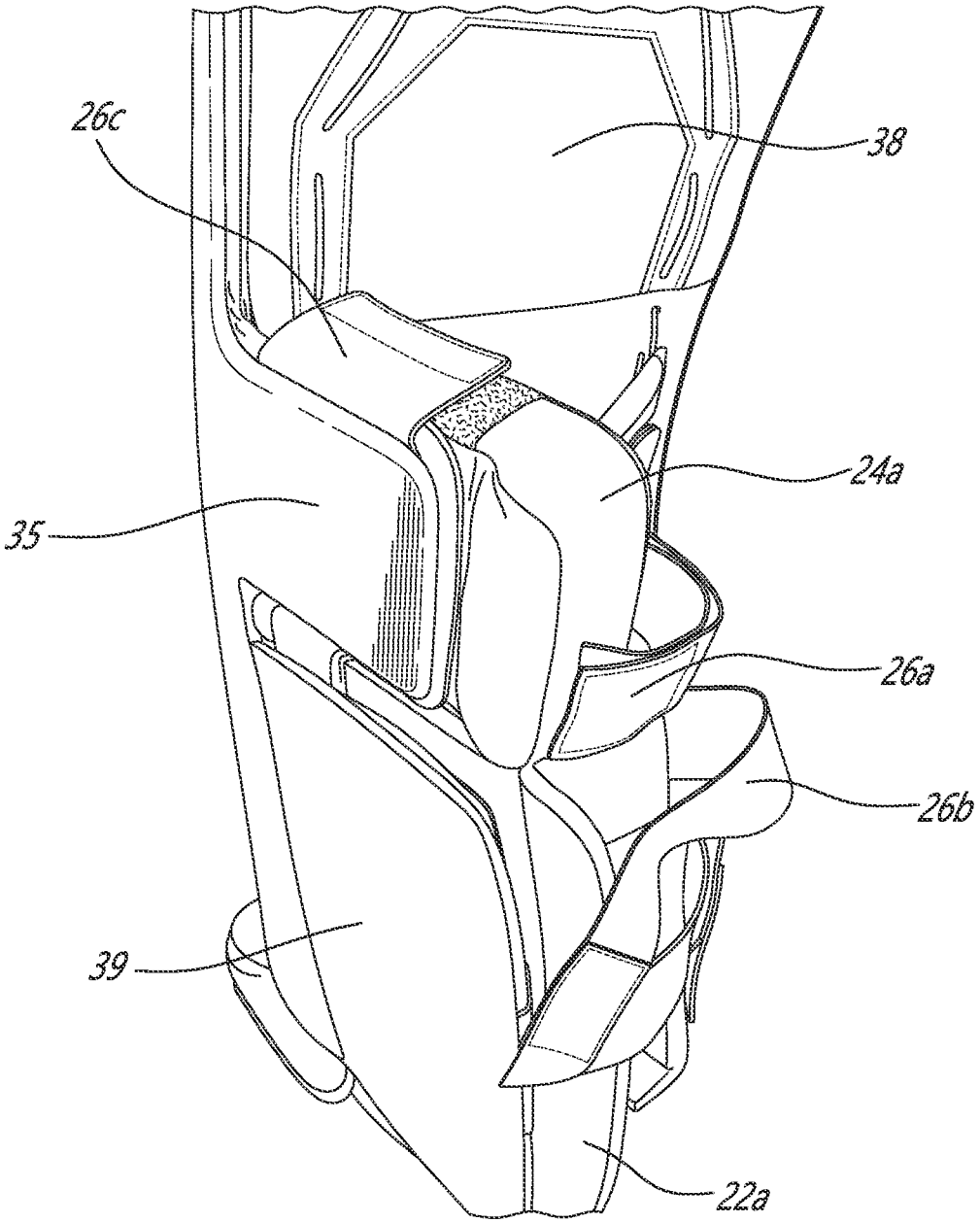
FIG. 3*a* is a three dimensional rear view of the right leg pad of FIG. 1.

Referring more particularly to FIG. 3, the inner paddings 20 include calf flaps and knee flaps. Namely, the calf flaps includes a medial calf flap 22*a* and a lateral calf flap 22*b* and the knee flaps includes a knee stack 24*a* and a outer knee flap 24*b*. The knee stack 24*a* may be a single piece, but may comprise a plurality of pieces, hence the moniker "stack", where a surface in direct contact with a knee of the wearer has more of an absorption function and whereas a remainder of the knee stack 24*a* has a raising purpose to increase a distance between the ice and the knee of the wearer when the wearer is in a butterfly position. The thicker the knee stack 24*a*, the less stress is imparted on a knee joint of the wearer when the latter is in the butterfly position. A single piece knee stack may have to have the right equilibrium in terms of softness/rigidity with the portion in contact with the knee being softer and the remaining portion being sturdier.

As shown in FIG. 3*a*, the knee stack 24*a* extends from a proximal end at a rear section 38 of the leg pad 10 to a distal end. The knee stack 24*a* has a first section extending from the proximal end and a second section extending from the first section to the distal end. A thickness of the first section is less than that of the second section to accommodate a knee pad, which will be described further below. Therefore, an outside face of the second section of the knee stack 24*a* is substantially aligned with an outside face of the knee pad thanks to the difference in thicknesses of the first and second sections of the knee stack 24*a*. Moreover, the second section of the knee stack 24*a* protrudes beyond a distal end of the knee pad. Straps 26*c* are used to secure the knee pad to the knee stack 24*a*. Hook and loop fasteners may be used for that purpose, but any other fastening means, such as snap buttons, are contemplated.

The medial calf flap 22*a*, lateral calf flap 22*b*, knee stack 24*a*, and outer knee flap 24*b* may be stitched to a rear side of the outer padding 30 and may be pivotable relative to the outer padding 30. The medial calf flap 22*a*, lateral calf flap 22*b*, knee stack 24*a*, and outer knee flap 24*b* define a spacing S (FIG. 3) between them. The spacing S is sized and shaped, and thus configured, to receive the leg of the wearer. A knee strap 26*a* is used to secure the knee stack 24*a* to the outer knee flap 24*b* by going around a rear side of the leg of the wearer and is used to hold a leg of the wearer in place within the spacing S. The knee strap 26*a* may also be used to keep a medial knee pad and the knee stack 24*a* combo in place, to avoid such a combo from floating freely and potentially protruding between legs of the wearer during play, which might be prohibited by some regulations. It is however possible for this combo to be held in place differently, such that the knee strap 26*a* does not have to be connected to such combo. A calf strap 26*b* is used to secure the medial calf flap 22*a* to the lateral calf flap 22*b* by going around the rear side of the leg of the wearer. These knee strap 26*a* and the calf strap 26*b* may be adjusted to securely attach the leg pad 10 to the leg of the wearer.

Figure 2:
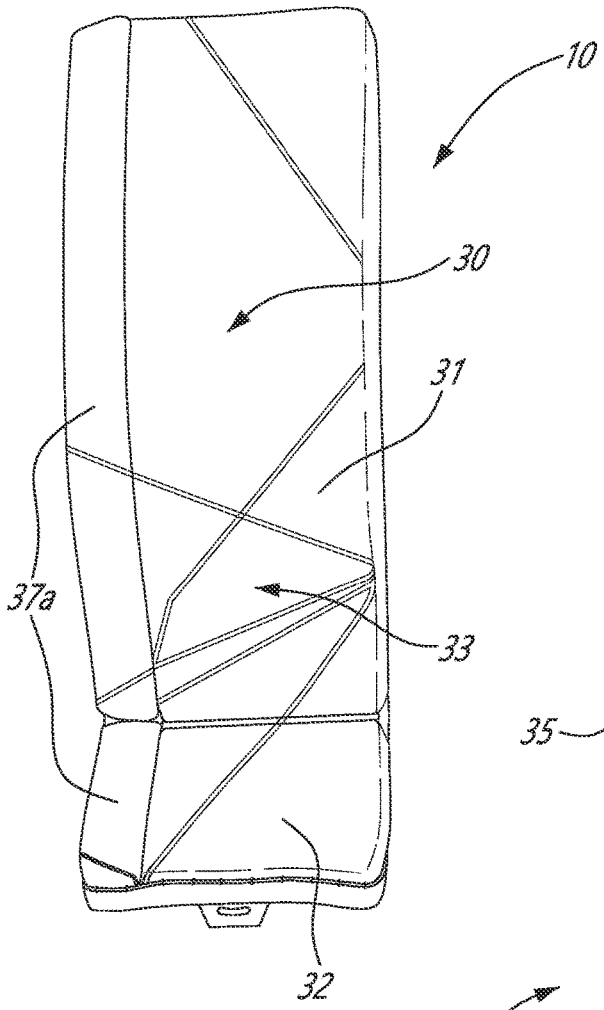
FIG. 2 is a front view of the right leg pad of FIG. 1.

Referring to FIGS. 1-2, the outer padding 30 includes a leg member 31 and a foot member 32 connected to the leg member 31. The leg member 31 and the foot member 32 may be somewhat pivotable one relative to the other. The leg member 31 is used to cover the front of the lower part of the leg and a portion of a thigh of the wearer whereas the foot member 32 is used to cover at least partially a foot, skate and/or ankle of the wearer. The foot member 32 may extend generally transversally, forwardly, relative to the leg member 31.

Referring to FIGS. 1-5, the outer padding 30 includes generally an outer shell 33. The outer shell 33 defines an internal pocket therein that is sized to receive a core 34 (FIG. 11), commonly referred to as the goalie pads' core. The core 34 is disposed within and/or extends along both of the leg member 31 and the foot member 32 of the outer padding 30. The core 34 may include a plurality of different padding elements which may be secured (e.g., glued, laminated, stitched, nested . . . ) to one another to define the shape of the leg pad 10. The outer shell 33 therefore encloses the leg member 31 and the foot member 32 of the outer padding 30 of the leg pad 10. In some embodiments, having a plurality of pieces for the core 34 may allow to more easily achieve a pivoting of the leg member 31 in relationship to the foot member 32.

Typically, a leg pad includes a knee pad that is configured to register with a knee of the wearer and to contact the ice when the wearer is in the butterfly position. This knee pad is usually a separate piece of padding that is assembled to a remainder of the leg pad 10. This configuration is a result of a manufacturing technique. Namely, a typical leg pad has a facing section, to which are attached a medial section and lateral gusset section, with all flaps being attached separately for ease of overall manufacturing. This manufacturing process results in having a hinge between the medial section and the knee pad. That is, the knee pad is usually stitched to a remainder of the leg pad 10. However, such an assembly of the knee pad by stitching creates a hinge at an intersection between the knee pad and the remainder of the leg pad. This hinge allows the knee pad to pivot substantially freely. However, in some circumstances, this hinge and the pivot movement it allows may be undesirable.

Figure 4:
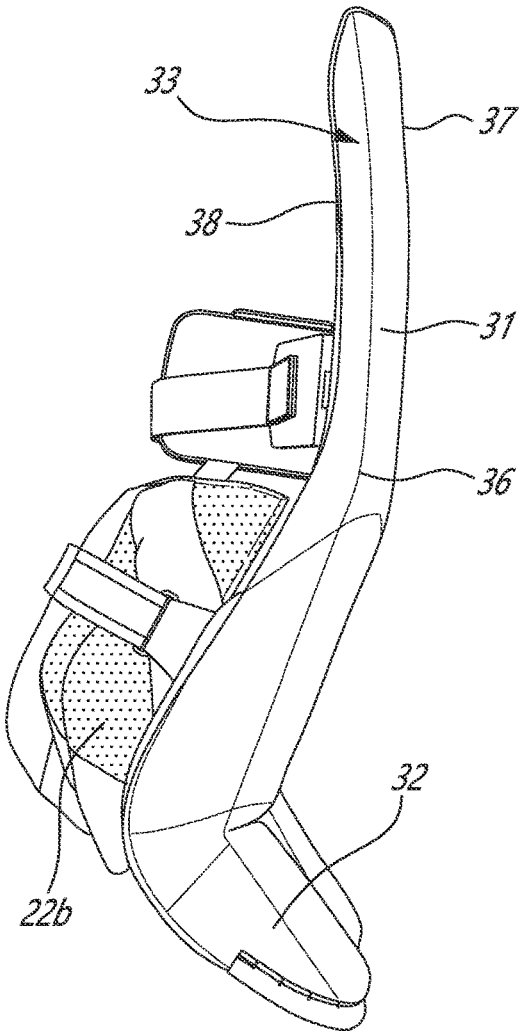
FIG. 4 is a lateral side view of the right leg pad of FIG. 1.
Figure 5:
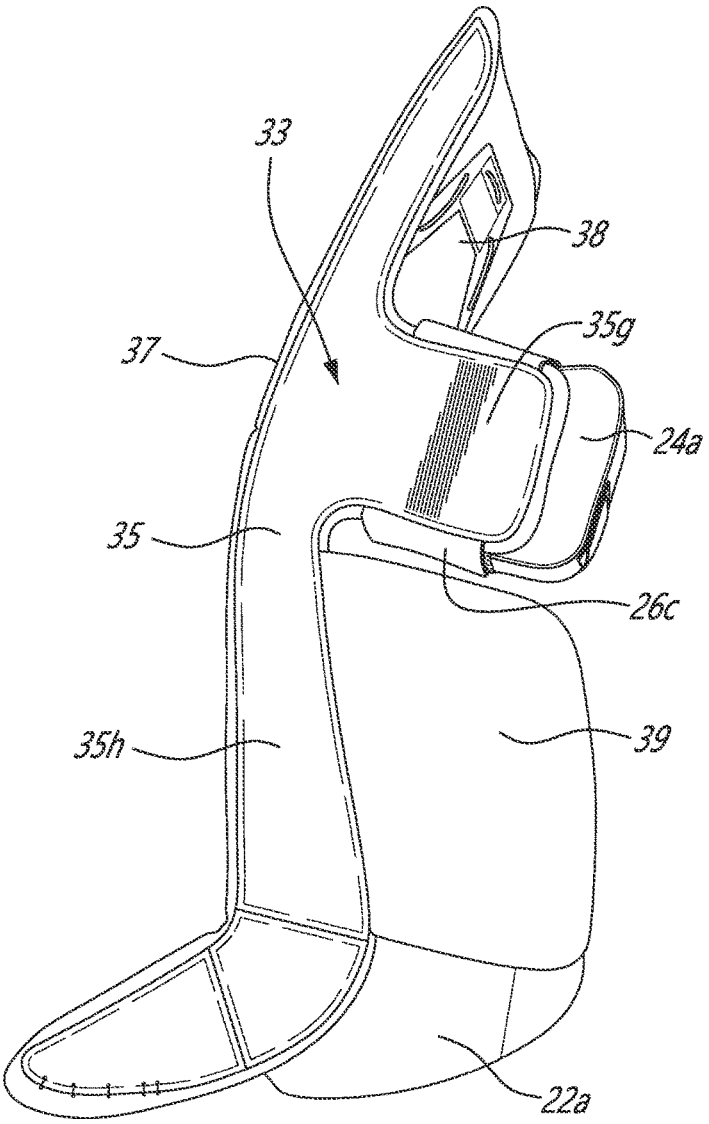
FIG. 5 is a medial side view of the right leg pad of FIG. 1.

As shown in FIGS. 4-5, the outer shell 33 is composed of a medial section 35, a lateral gusset section 36, a facing section 37, and a rear section 38. As shown more clearly in FIG. 1, the facing section 37 of the outer shell 33 defines outer-roll protrusions 37*a* located proximate a lateral edge of the leg pad 10 and that protrude away from a remainder of the facing section 37 and away from the rear section 38. The outer-roll protrusions 37*a* extend over both of the leg member 31 and the foot member 32 of the outer padding 30 of the leg pad 10. The outer-roll protrusions 37*a* may allow a better control of the puck by the wearer of the leg pad 10. The outer-roll protrusions 37*a* are designed to allow a pivotal movement of the leg member 31 in relationship to the foot member 32.

The outer shell 33 may be assembled by stitching together the medial section 35, the lateral gusset section 36, the facing section 37, and the rear section 38 along their respective peripheral edges. Understandably, the core 34 is inserted into the pocket of the outer shell 33 before the pocket is fully stitched closed. The assembly steps of the leg pad 10 are described herein below.

The medial calf flap 22*a*, lateral calf flap 22*b*, knee stack 24*a*, and outer knee flap 24*b* of the inner paddings 20 may be stitched along one of their edges to the rear section 38 of the outer shell 33. Hence, the medial calf flap 22*a*, lateral calf flap 22*b*, knee stack 24*a*, and outer knee flap 24*b* may be pivotable relative to the outer shell 33 along their stitched lines via which they are connected to the outer shell 33 at the rear section 38. These stitched lines may therefore correspond to live hinges between the medial calf flap 22*a*, lateral calf flap 22*b*, knee stack 24*a*, and outer knee flap 24*b* and the outer shell 33.

The outer knee flap 24 *b* (FIG. 3) may be used for providing increased comfort to the wearer in terms of the attachment of the knee strap 26 *a* around the leg of the wearer. As a secondary purpose, a degree of protection may be offered by the outer knee flap 24*b*. The knee strap 26 *a* may be fastened, via hook and loop fasteners in one embodiment, to the lateral calf flap 22*b*. A fastening surface 22*c* (FIG. 3) is defined on the lateral calf flap 22*b* for fastening the calf strap 26*b*. The lateral calf flap 22*b* may be used to provide comfort to the wearer and may offer a degree of protection. In some embodiment, it may offer an alternate attachment location for the knee strap 26*a*. The medial calf flap 22*a* may have a similar function as the outer knee flap 24*b*, that is, wrap-around comfort and some degree of protection.

As seen in FIG. 5, the outer padding 30 further includes a calf wing 39 that may be stitched to the medial side 12 of the leg pad 10 and adjacent the medial calf flap 22*a*. Hook and loop fasteners may be used to hold the calf wing 39 and the medial calf flap 22*a* together. Any suitable fastening means, such as quick release buckles, standard buckles, snap buttons, and so on may alternatively be used. An outer surface of the calf wing 39 may be in direct contact with the ice when the wearer is in the butterfly position. It may assist the wearer in gliding on the ice and offers protection. The calf wing 39 may be prohibited from floating freely and from protruding between the legs of the wearer per some regulations. As shown in FIG. 3, the calf strap 26*b* may have an extremity thereof secured to the calf wing 39 and may extend around a buckle secured to the rear section 38 of the outer shell 33, or to the lateral calf flap 22*b*, proximate the lateral side 14 of the leg pad 10. An effective length of the calf strap 26*b* may be adjusted to bias the medial calf flap 22*a* and the lateral calf flap 22*b* against opposite sides of the leg of the wearer. Hook and loop fasteners may be used to allow the calf strap 26*b* to be removably securable to itself at a plurality of attachment points. Snap buttons or other suitable fastening means may alternatively be used. The calf strap 26*b* may have a similar function as the knee strap 26*a*, that is, to hold the leg of the wearer secured to the leg pad 10 and to keep the calf wing 39 in place. The calf wing 39 may be held in place via other means, such as hook and loop fasteners between the calf wing 39 and the medial calf flap 22*a*. The knee strap 26*a* may be secured to the medial section 35 at one extremity and may be removably securable to the outer knee flap 24*b* at its opposed extremity. Hook and loop fasteners may be used to removably secure the knee strap 26*a* to the outer knee flap 24*b* at a plurality of attachment points. Snap buttons or other suitable fastening means may alternatively be used.

Figure 6:
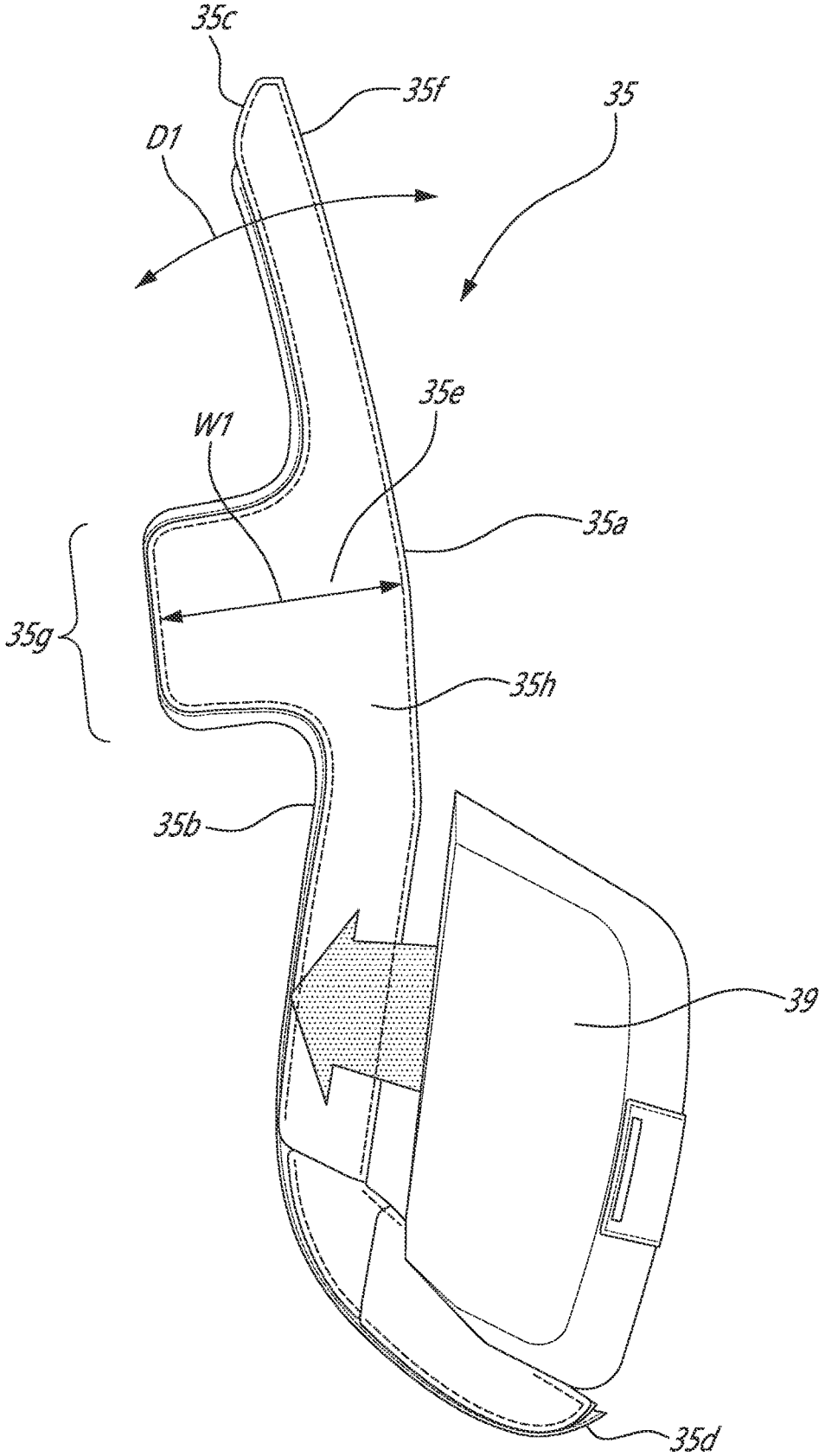
FIG. 6 is a medial side plan view of a medial section of the right leg pad of FIG. 1.

As shown in FIGS. 5-6, the medial section 35 includes a medial pad 35*f* that includes a knee pad 35*g* and a longitudinal pad 35*h*. This medial pad 35*f* is made of a single monolithic body that extends uninterrupted to define both of the knee pad 35*g* and the longitudinal pad 35*h* of the medial section 35. As will be explained below, performance gains for the wearer may be achieved using this unitary construction of the medial pad 35*f*. Namely, a stiffness of the medial section 35 is increased thanks to the medial pad 35*g* being free of any hinge, and thus substantially non-rotatable relative to one another, at an intersection between the knee pad 35*g* and the longitudinal pad 35*h* of the monolithic medial pad 35*f*. The knee pad 35*g* may be integrated to the knee stack 24*a*, but having two separate pieces may facilitate the manufacturing of the leg pad 10. Herein, the expression "non-rotatable" means that the knee pad 35*g* does not pivot freely relative to the longitudinal pad 35*h* and that pivoting the knee pad 35*g* relative to the longitudinal pad 35*h* requires exerting sufficient force to bend a material of the medial pad 35*f*.

Still referring now to FIG. 6, the medial section 35 includes a front edge 35*a*, a rear edge 35*b*, a top edge 35*c*, and a bottom edge 35*d*. The top edge 35*c* and the bottom edge 35*d* extend from the front edge 35*a* to the rear edge 35*b*. In an embodiment, the top edge 35*c* and the bottom edge 35*d* may be part of the front edge 35*a* and the rear edge 35*b* converging toward one another to close the pocket of the outer shell 33. The medial section 35 includes an outer casing 35*e* that covers an outwardly facing side of the medial pad 35*f* of the medial section 35. In the embodiment shown, the knee pad 35*g* of the medial section 35 covers a knee of the wearer and the longitudinal pad 35*h* extends from the upper end 10*a* to the lower end 10*b* of the leg pad 10. More specifically, the outer casing 35*e* is free of a stitch line extending therethrough and thus defines a continuous, uninterrupted pocket, to receive the medial pad 35*f* that includes the single monolithic block of padding that defines both of the knee pad 35*g* and the longitudinal pad 35*h*. In other words, the knee pad 35*g* extends integrally and monolithically from the longitudinal pad 35*h*. The knee pad 35*g* extends in a transverse direction from the longitudinal pad 35*h*. They may be considered as different portions or sections of a single monolithic body forming the medial pad 35*f*. This monolithic body of the medial pad 35*f* may be made of a high density foam.

Accordingly, the knee pad 35*g* and the adjacent portion of the longitudinal pad 35*h* are monolithic. However, the entirety of the medial section 35 need not be monolithic, and may for example be formed by multiple pieces to enable flexibility in the front-to-back plane. The lack of any stitching and/or hinge connection line between knee pad 35*g* and adjacent longitudinal pad 35*h* of the medial section 35 results in an increased rigidity in the resulting plane formed by the ice-contacting surface of the knee page 35*g* and the adjacent portion of the longitudinal pad 35*h*. Thus, for pivoting the knee pad 35*g* in relationship to the longitudinal pad 35*h*, it is required to bend a material of the medial pad 35*f*. A thickness of the medial pad 35*f* may be substantially constant from the front edge 35*a* to the rear edge 35*b*.

Figure 6A:
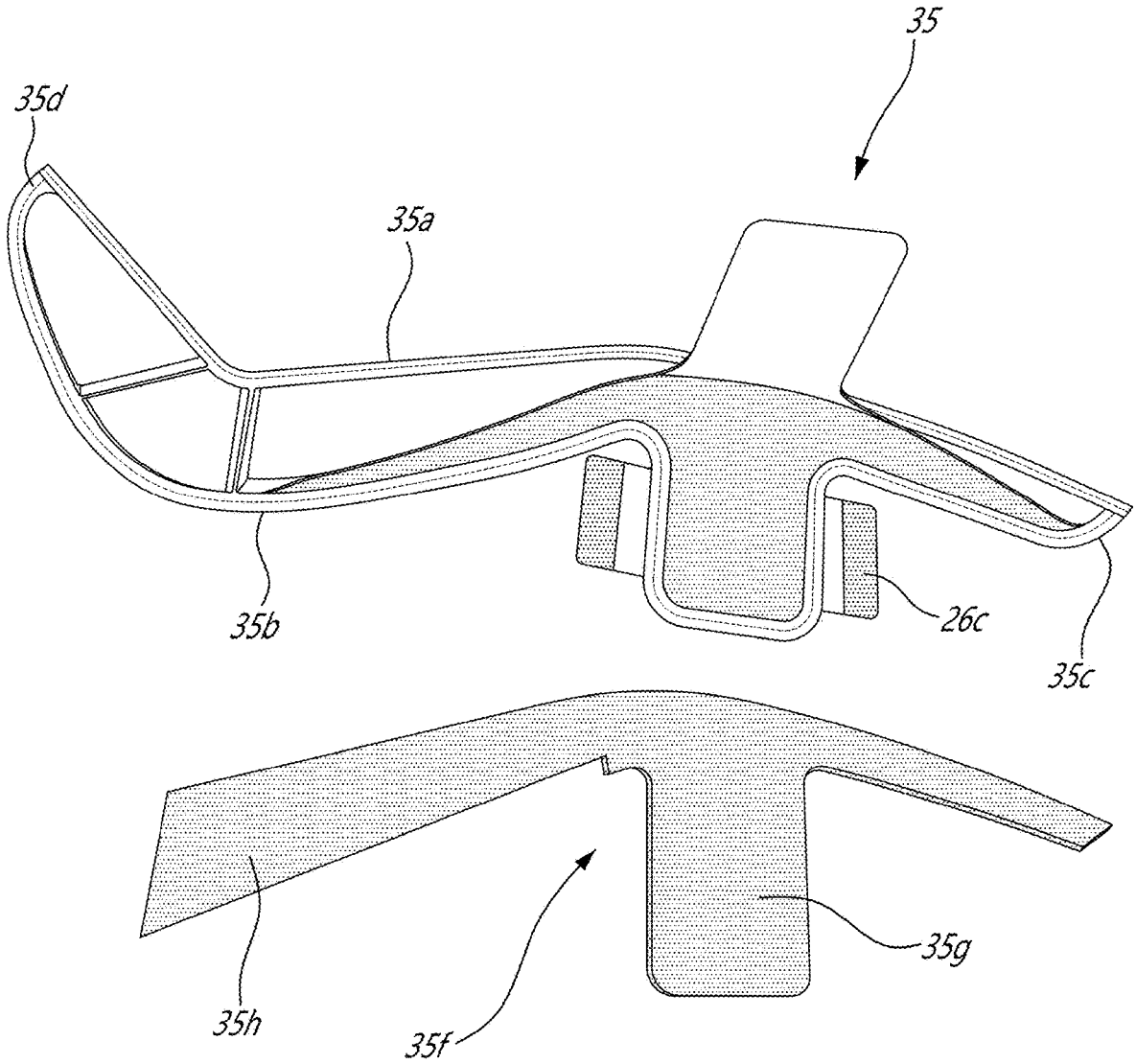
FIG. 6*a* is a plan exploded view illustrating a medial section of the right leg pad of FIG. 1, the medial section including an outer casing and a medial pad.

Referring to FIGS. 6 and 6*a*, the medial pad 35*f* may include three pieces (one piece being removed from an outside casing for illustration purposes) distributed longitudinally between the top edge 35*c* and the bottom edge 35*d*; a top piece extending from the top edge 35*c* to a central piece; a bottom piece extending from the bottom edge 35*d* to the central piece; and the central piece that may be located at an elbow section defined by the medial section 35. The top piece extends monolithically from the front edge 35*a* to the rear edge 35*b* and defines both the knee pad 35*g* and a portion of what is shown as the longitudinal pad 35*h* in FIG. 6. This embodiment, while retaining the rigid aspect of the knee stack because of the hinge elimination, may allow a better front-to-back flexibility of the pad 10 along directions D1. Consequently, while both pads would have the desired knee stack rigidity, both would offer different front-to-back flexibility. As shown, the three pieces of the medial pad 35*f* are contained in a casing that may be stitched along its perimeter to secure the three pieces in the casing. Stitch lines may be provided between the three pieces, and may extend from the front edge 35*a* to the rear edge 35*b*, to prevent the pieces from moving within the casing.

"Monolithic" as defined herein with respect to the medial pad 35*f* is understood to mean that there is no live hinge(s) between the knee pad 35*g* and the longitudinal pad 35*h* of the medial pad 35*f*, and thus that substantially no pivotable or rotational movement therebetween is possible (without permanently deforming the medial pad 35*f*). However, as explained above, the knee pad 35*g* may include a three-piece construction as long as a single piece extends monolithically to define both of a portion of the longitudinal pad 35*h* and the knee pad 35*g*.

The knee pad 35*g* may therefore correspond to a rearwardly extending protrusion that extends away from the longitudinal pad 35*h*, with the rear edge 35*b* therefore protruding away from both the front edge 35*a*, and from a rear edge of the longitudinal pad 35*h*, at the knee pad 35*g*. The monolithic medial pad 35*f* extends over an entirety of the medial section 35 to define the knee pad 35*g* and the longitudinal pad 35*h*. In other words, there is no hinge, stitch, live hinge, and so on, between the knee pad 35*g* and the longitudinal pad 35*h* of the medial pad 35*f*, and as such that substantially no relative rotational movement between the knee pad 35*g* and the longitudinal pad 35*h* is possible along a longitudinal axis extending from a top to a bottom of the pad 10. The medial section 35 is thus free of a pivotal connection between its different constituents. The knee pad 35*g* may be substantially non-rotatable relative to the longitudinal pad 35*h*. That is, a thickness of the medial pad 35*f* may be substantially uniform from the longitudinal pad 35*h* to the knee pad 35*g*. Hence, the medial pad 35*f* is free of a reduced thickness area between the knee pad 35*g* and the longitudinal pad 35*h*. If one were to rotate the knee pad 35*g* relative to the longitudinal pad 35*h* of the medial pad 35*f*, this person would be required to exert sufficient force to bend a material of the medial pad 35*f*. Therefore, the knee pad 35*g* does not swivel easily relative to the longitudinal pad 35*h*. The knee pad 35*g* is therefore a monolithic extension of the longitudinal pad 35*h* in a rearward direction away from the front edge 35*a*. The medial section 35 is therefore free of stitch line at an intersection between its knee and longitudinal portions. A width W1 of the medial pad 35*f* at the knee pad 35*g* extends uninterrupted from the front edge 35*a* to the rear edge 35*b*. A stiffness of the high-density foam used for the medial pad 35*f* will determine the stiffness of the knee pad 35*g* when a force is exerted on the knee pad 35*g* to rotate the knee pad 35*g* about a longitudinal axis extending from the top to the bottom of the pad 10. And, the unitary nature or not of the high-density foam used from top to bottom of the medial pad 35*f* will determine the extent of movements in the direction D1. In the embodiment shown, the medial section 35 of the outer shell 33 is free of direct connection to the rear section 38 of the outer shell 33 along an intersection between the longitudinal pad 35*h* and the knee pad 35*g*. In other words, the pocket of the outer shell 33 has a core volume receiving the core padding 34, a knee pad volume receiving the knee pad 35*g*, and a longitudinal pad volume receiving the longitudinal pad 35*h*. The knee pad volume uninterruptedly communicates with the longitudinal pad volume for receiving a monolithic body defining the knee pad 35*g* and the longitudinal pad 35*h*. During assembly, inserting the knee pad 35*g* is inserted inside the knee volume and the longitudinal pad 35*h* is inserted inside the longitudinal volume.

Having the knee pad 35*g* monolithic with the longitudinal pad 35*h* of the medial pad 35*f* may allow a reduced a number of pieces of the leg pad 10; increased a stiffness of the knee pad 35*g*; improved a sliding motion of the leg pad 10 on an ice surface; and/or allow for a more responsive movement of the wearer of the leg pad 10. More specifically, in use, the wearer may move his or her legs such that the medial section 35 is in contact with the ice. This is known as the "butterfly" position. In so doing, knees of the wearer abut the knee pads 35*g* of the medial pads 35*f* of the leg pads 10. The wearer is then required to either move quickly in a lateral direction or to revert back from the butterfly position to a standing position. Having the knee pad 35*g* solidary and monolithic with the longitudinal pad 35*h* of the knee pad 35*g* may help the wearer carrying out those movements by being more responsive to force inputs provided by the wearer, thereby reducing reaction time, reducing energy loss, increasing force transfer from the wearer's knee to the pad. The monolithic construction of the knee pad 35*h* and the longitudinal pad 35*h* may also help the wearer to move around on and/or up or down from/to the ice.

Additionally, the monolithic construction of the knee pad 35*g* and the longitudinal pad 35*h*, given that no stitched hinge exists therebetween, may also help to create a substantially uninterrupted planar surface that extends fully along the medial-most surface of the medial pad 35*f*. This may help to reduce friction between the pad and the ice surface. Given how much time goaltenders spend in the butterfly position, with this surface of the medial pad 35*f* in contact with the ice and sliding back and forth on this surface, any small reduction in surface friction may result in split second improvements in displacement along the ice, for example from one goalpost to the other. This reduction in friction may be caused by the fact that ice/snow can no longer accumulate into a recess at the stitch line between medial and longitudinal pads because said recess is removed by the monolithic construction of the medial pad 35*f*. Moreover, the removal of this stitch line may increase a durability of the leg pad 10 since any stitch line may be subjected to wear and tear. Given that even millisecond improvements in sliding displacement along the ice can sometimes mean the difference between stopping the puck and not, any reduction in surface friction between the outer surface of the medial pad 35*f* and the ice remains desirable. To a greater degree, the added stiffness of the knee pad 35*g*, thanks to its monolithic construction with the longitudinal pad 35*h*, may allow the wearer to be more reactive, reduce reaction time, ease movements between the standing and butterfly positions, direct energy transfer between the wearer and the ice via the stiff knee pad and so on.

As shown in FIG. 5, the strap 26*c* may be used to fasten the knee pad 35*g* of the medial section 35 to the knee stack 24*a*. Alternatively, hook and loop fasteners or snap buttons may be used without departing from the scope of the present disclosure.

The different components of the leg pad 10 having been described, a method to assemble the leg pad 10 is described herein below with reference to FIGS. 6-11, with continued reference to FIGS. 1-5. Having the knee pad 35*g* part of the medial section 35 of the outer shell 33—as opposed to being stitched as a separate piece at a later time—confer certain advantages in terms of the assembly process of the leg pad 10. Namely, it may be impossible to simply dispose the core 34 between the facing section 37 and the rear section 38 of the outer shell 33 and to stitch along a perimeter thereof.

The method may include obtaining the outer shell 33; securing the medial pad 35*f* to the medial section 35 of the outer shell 33; inserting the core padding 34 inside the pocket of the outer shell 33; and closing an opening of the pocket by securing the rear edge 35*b* of the medial section 35 of the outer shell 33 to the medial edge 38*a* of the rear section 38 of the outer shell 33 by contouring a perimeter of the knee pad 35*g* such that a thickness of the medial pad 35*f* at an intersection between the knee pad 35*g* and the longitudinal pad 35*h* is substantially equal to the thickness of the medial pad 35*f* at opposite sides of the intersection.

Referring to FIG. 6, the calf wing 39 may be secured to the medial section 35. In the embodiment shown, the calf wing 39 is stitched to the medial section 35 proximate the rear edge 35*b* of the medial section 35. Similarly, the inner paddings 20 may be secured to the rear section 38. That is, the medial calf flap 22*a*, lateral calf flap 22*b*, knee stack 24*a*, and outer knee flap 24*b* may be stitched to the rear section 38 of the outer shell 33 of the outer padding 30.

Figure 7:
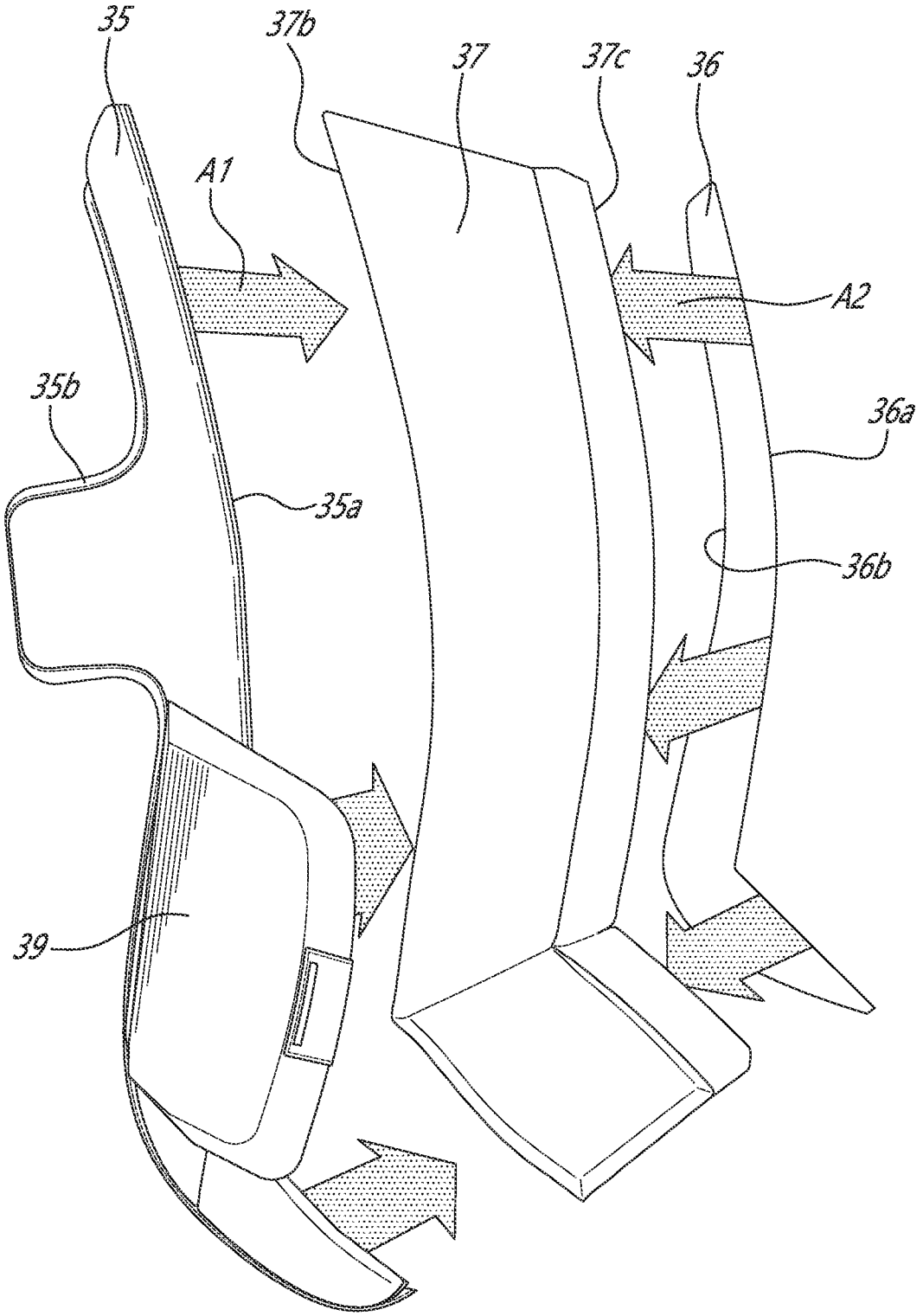
FIG. 7 is a three dimensional exploded view of medial, facing, and lateral sections of a left leg pad, the left leg pad being a mirror image of the right leg pad of FIG. 1.

Referring to FIG. 7, in the embodiment shown, the outer shell 33 is partially assembled by securing the medial section 35, the facing section 37, and the lateral gusset section 36 together. In the present case, the front edge 35*a* of the medial section 35 is stitched to a medial edge 37*b* of the facing section 37. A lateral edge 37*c* of the facing section 37 of the outer shell 33 and a front edge 36*a* of the lateral gusset section 36 are stitched together. Arrows A1 and A2 illustrate directions of assembly of the medial section 35, facing section 37, and lateral gusset section 36.

Figure 8:
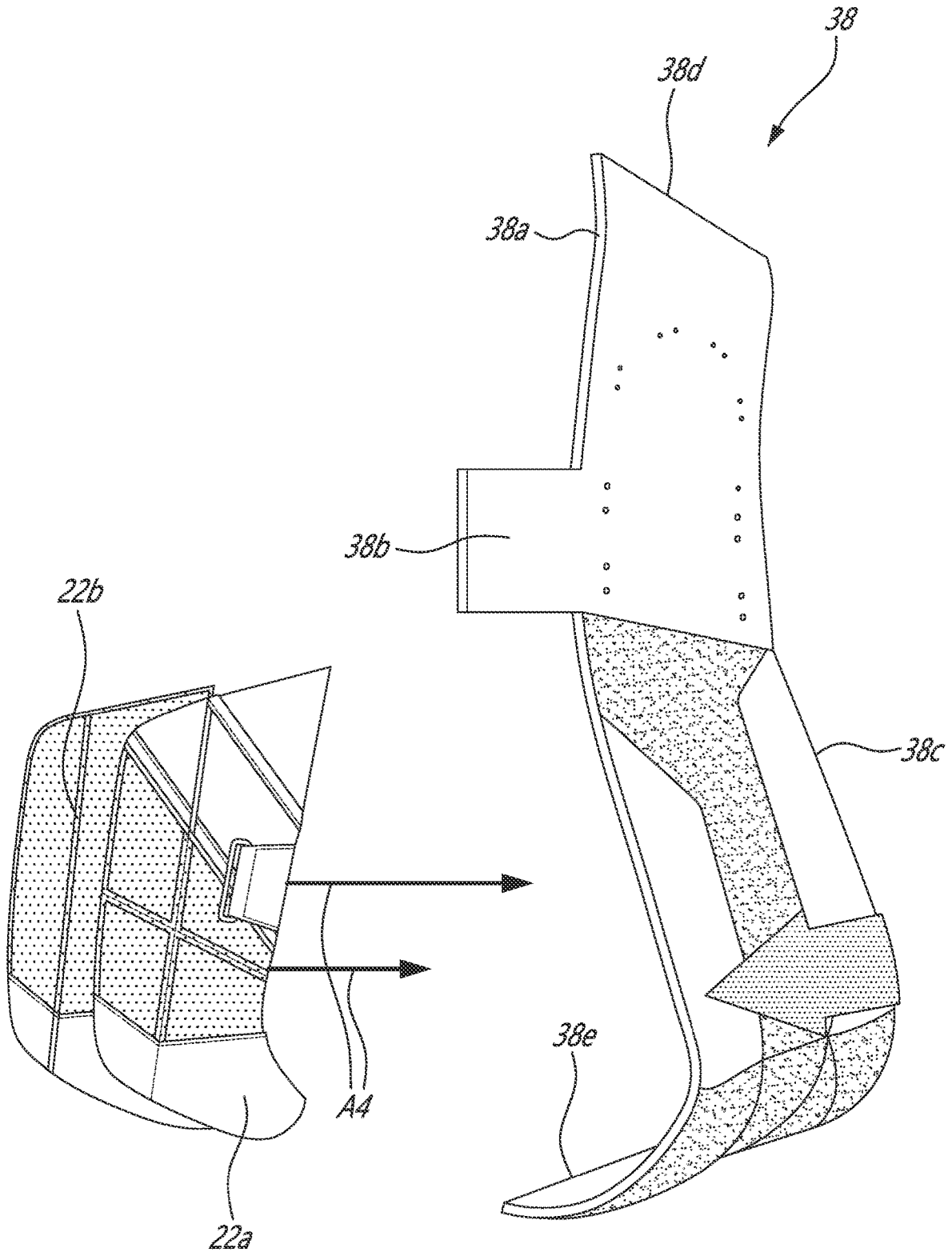
FIG. 8 is a three dimensional exploded view showing the rear section and lateral and medial calf flaps of the left leg pad of FIG. 7.

As shown in FIG. 8, the medial calf flap 22*a* and the lateral calf flap 22*b* may be stitched to the rear section 38. Arrows A4 illustrate movement of the medial calf flap 22*a* and the lateral calf flap 22*b* relative to the rear section 38. Alternatively, the medial calf flap 22*a* and the lateral calf flap 22*b* may be secured to the rear section 38 at a later time, after the outer shell 33 is being flipped.

Figure 9:
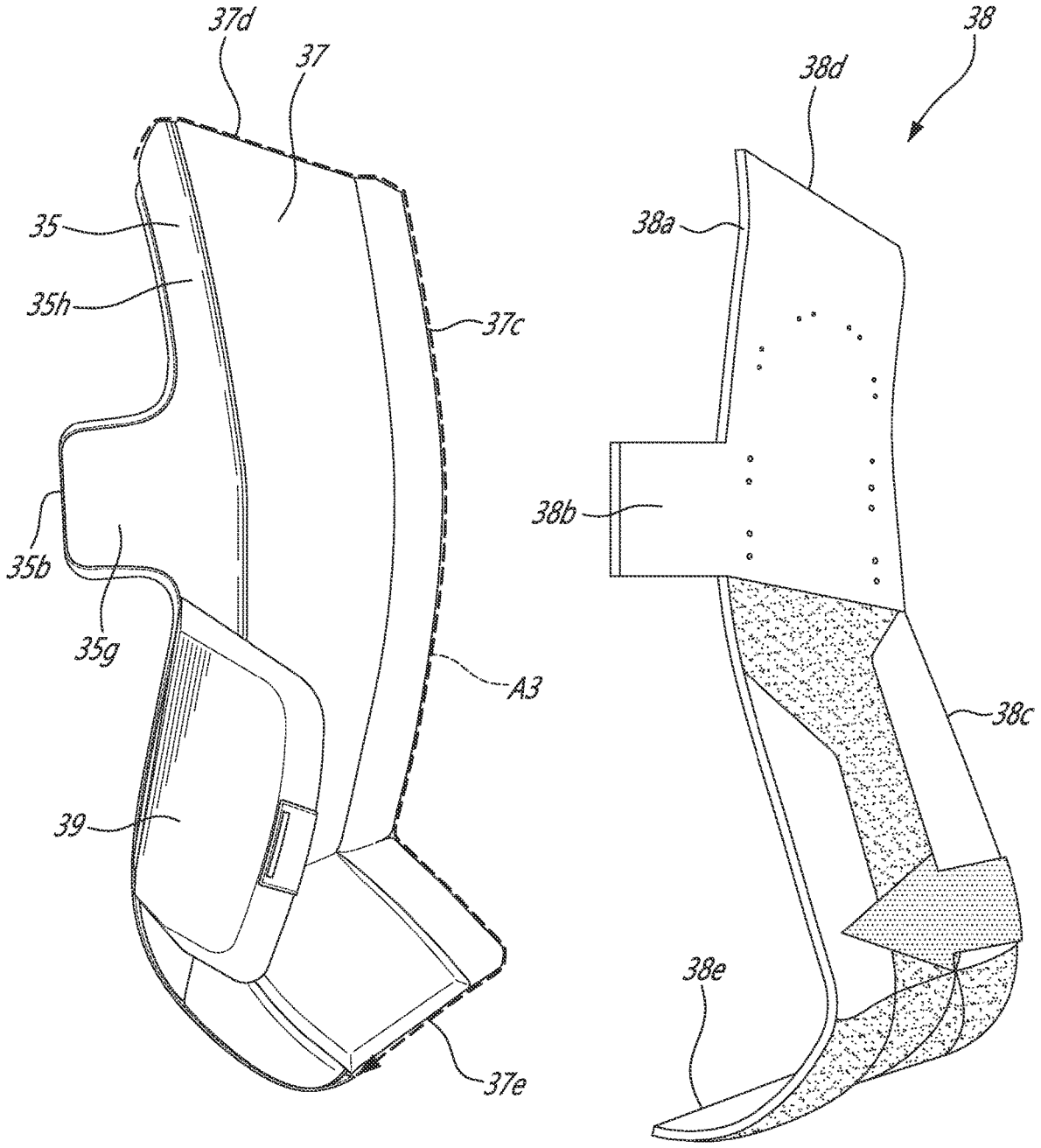
FIG. 9 is a three dimensional exploded view of the left leg pad of FIG. 7 showing parts of an outer shell of the leg pad.

Referring now to FIG. 9, the medial calf flap 22*a* and the lateral calf flap 22*b* are removed for illustration purposes.

Figure 11:
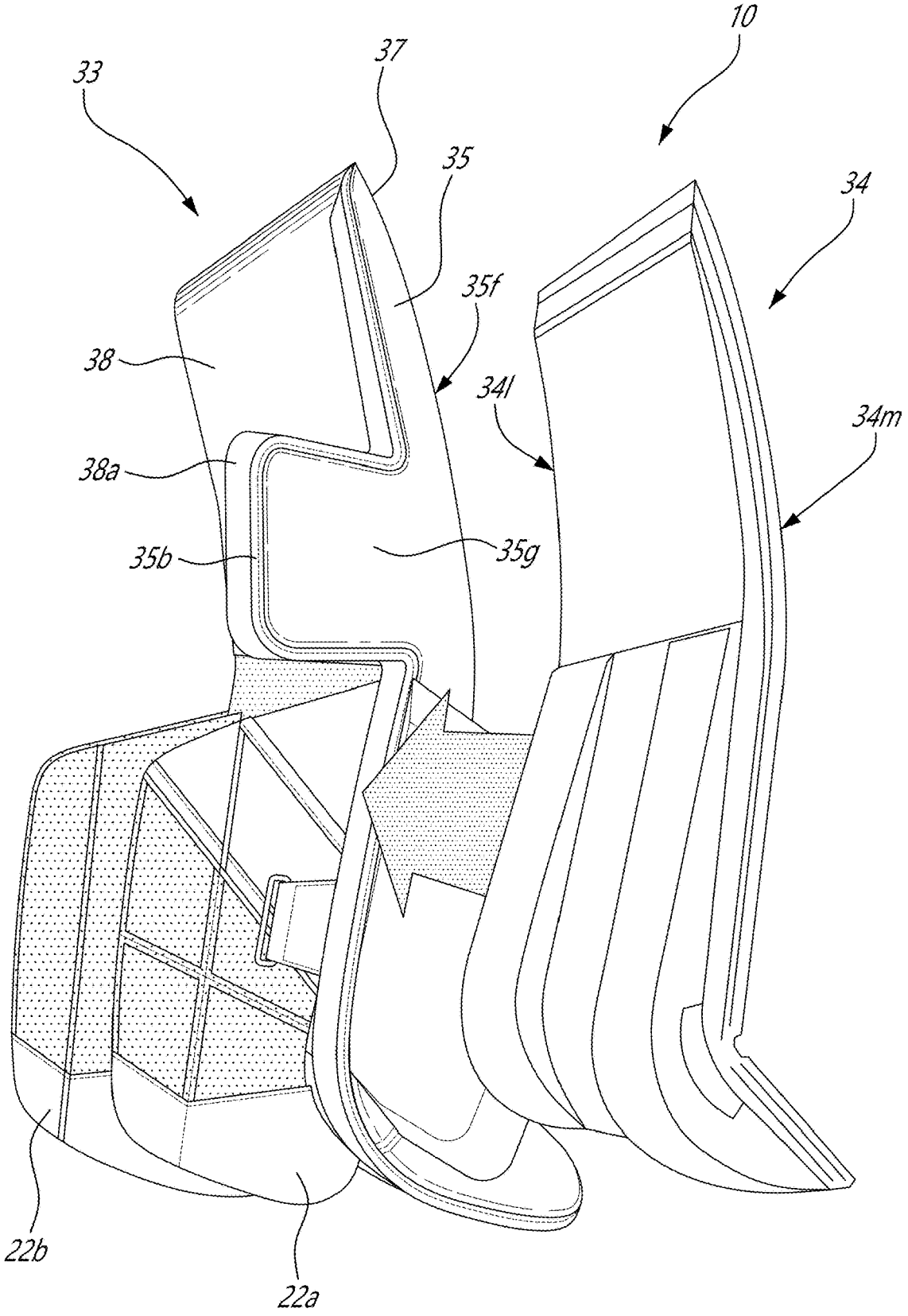
FIG. 11 is a three dimensional exploded view showing the outer shell and a core padding of the left leg pad of FIG. 7.

The rear section 38 has a medial edge 38*a* that follows a contour of the knee pad 35*g*. In other words, the rear section 38 defines a protrusion 38*b* that extends generally transversally to a remainder of the rear section 38 and that is sized to cover the medial pad 35*f* (FIG. 6) of the medial section 35 at the knee pad 35*g*. Since the rear section 38 may be only an envelope to cover the knee pad 35*g*, the protrusion 38*b* may be a separate piece stitched to a remainder of the rear section 38. Therefore, the medial section 35 may have a first skin to cover a first side of the medial pad 35*f*, and the protrusion 38*b* of the rear section 38 acts as a second skin to cover a second opposed side of the medial pad 35*f* at the knee pad 35*g*. An opposed side of the medial pad 35*f* at the longitudinal pad 35*h* is facing toward an inside of the pocket of the outer shell 33 and may be in abutment against the core 34 (FIG. 11).

The closing of the pocket may include enclosing the knee pad 35*g* between the protrusion 38*b* of the rear section 38 of the outer shell 33 and a protrusion of the medial section 35*f* of the outer shell 33 such that the medial section 35 of the outer shell 33 is free of direct connection to the rear section 38 at the intersection between the longitudinal pad 35*h* and the knee pad 35*g*.

The rear section 38 further includes a lateral edge 38*c* opposed to the medial edge 38*a*, a top edge 38*d*, and a bottom edge 38*e* opposed to the top edge 38*d*. The facing section 37 and the rear section 38 are disposed such that their inner sides—the sides that will be in contact with the core 34—are facing away from one another. At which point, the rear section 38 may be secured to the medial section 35, facing section 37, and lateral gusset section 36 that have been stitched to one another as described above. In the embodiment shown, three sides of the rear section 38 are stitched to the facing section 37 and lateral gusset section 36. That is, the top edge 38*d* of the rear section 38 is stitched to a top edge 37*d* of the facing section 37; the lateral edge 38*c* of the rear section 38 is stitched to a rear edge 36*b* (FIG. 7) of the lateral gusset section 36; and the bottom edge 38*e* of the facing section 37 is stitched to a bottom edge 37*e* of the facing section 37. These three stitches may be done along a single stitch line following arrow A3. At this point, an opening remains by keeping the medial edge 38*a* of the rear section 38 free of direct connection to the rear edge 35*b* of the medial section 35.

Figure 10:
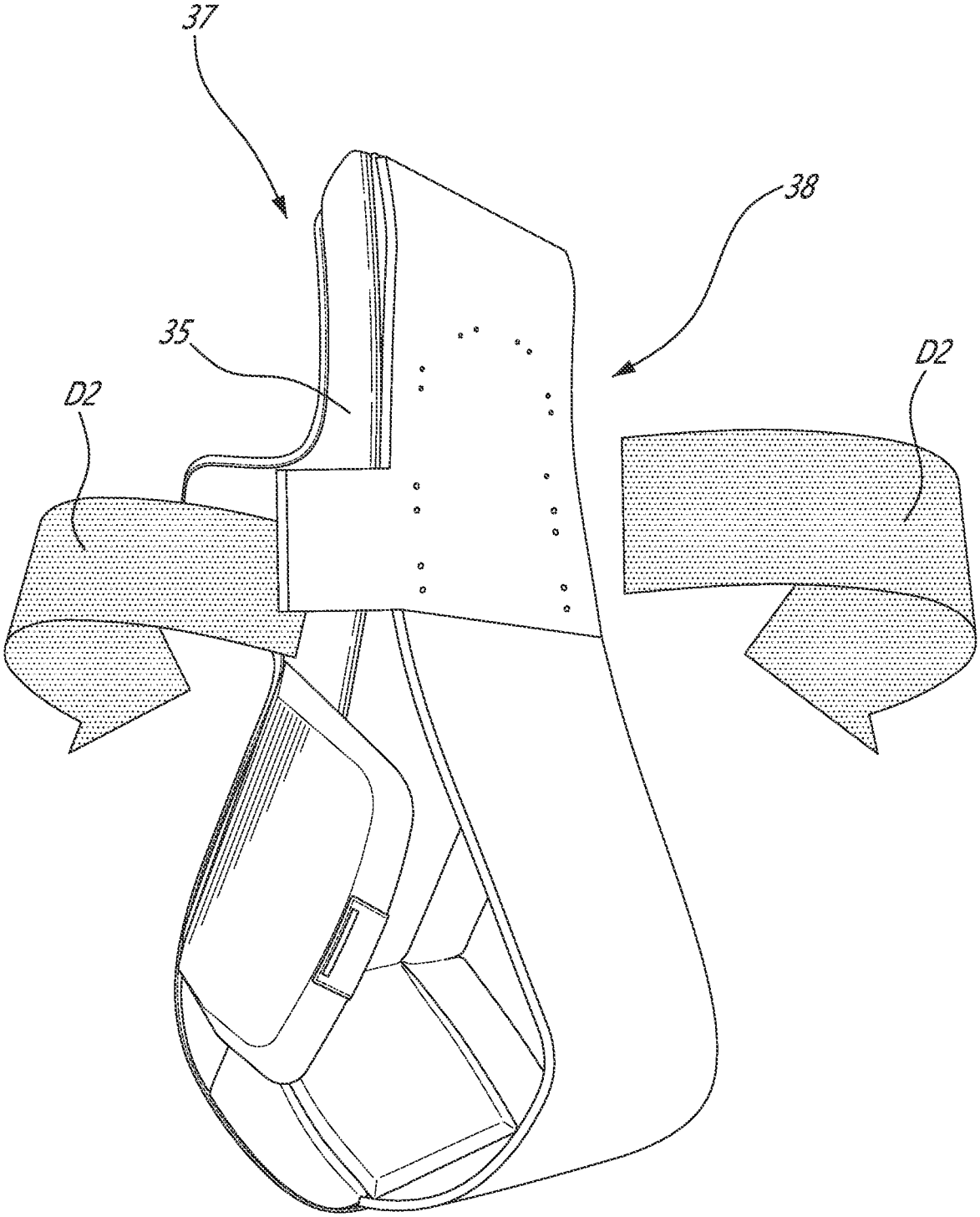
FIG. 10 is a three dimensional view of the left leg pad of FIG. 7 in a pre-assembled configuration and illustrating a reversing step.

Referring now to FIG. 10, the medial calf flap 22*a* and the lateral calf flap 22*b* are removed for illustration purposes. At this stage, outer shell 33 may be inverted, or flipped, inside out by pushing the lateral gusset section 36, the facing section 37, and the rear section 38 through the opening that remains between the medial edge 38*a* of the rear section 38 and the rear edge 35*b* of the medial section 35. Such a movement may be carried by moving medial sides of the facing section 37 and the rear section 38 away from one another along direction D2. This allows the inner sides of the facing section 37 and the rear section 38 to face one another. Moreover, this results in the flaps 22*a*, 22*b* from being located between the rear section 38 and the facing section 37 to being located outside the outer shell 33 and extending from the rear section 38 away from the front section 37. Therefore, since the outer shell 33 is flipped inside out, the stitch line extending along the arrow A3 lands on the inside of the outer shell 33 and may therefore be protected from wear and tear. This stitch line is therefore not visible and, consequently, no binding may be required. This may allow an economy in manufacturing time and cost. A binding may nevertheless be used if added protection at the edge is desired.

Once assembled, edges of the lateral section are each secured to a respective one of the front lateral edge and the rear lateral edge via one or more stitch lines. After the outer shell 33 is flipped inside out, the front lateral edge, the rear lateral edge, and the opposed front and rear lateral edges are located inside the pocket. In the present embodiment, the front medial edge, the rear medial edge, and the opposed front and rear medial edges located outside the pocket.

Figure 12:
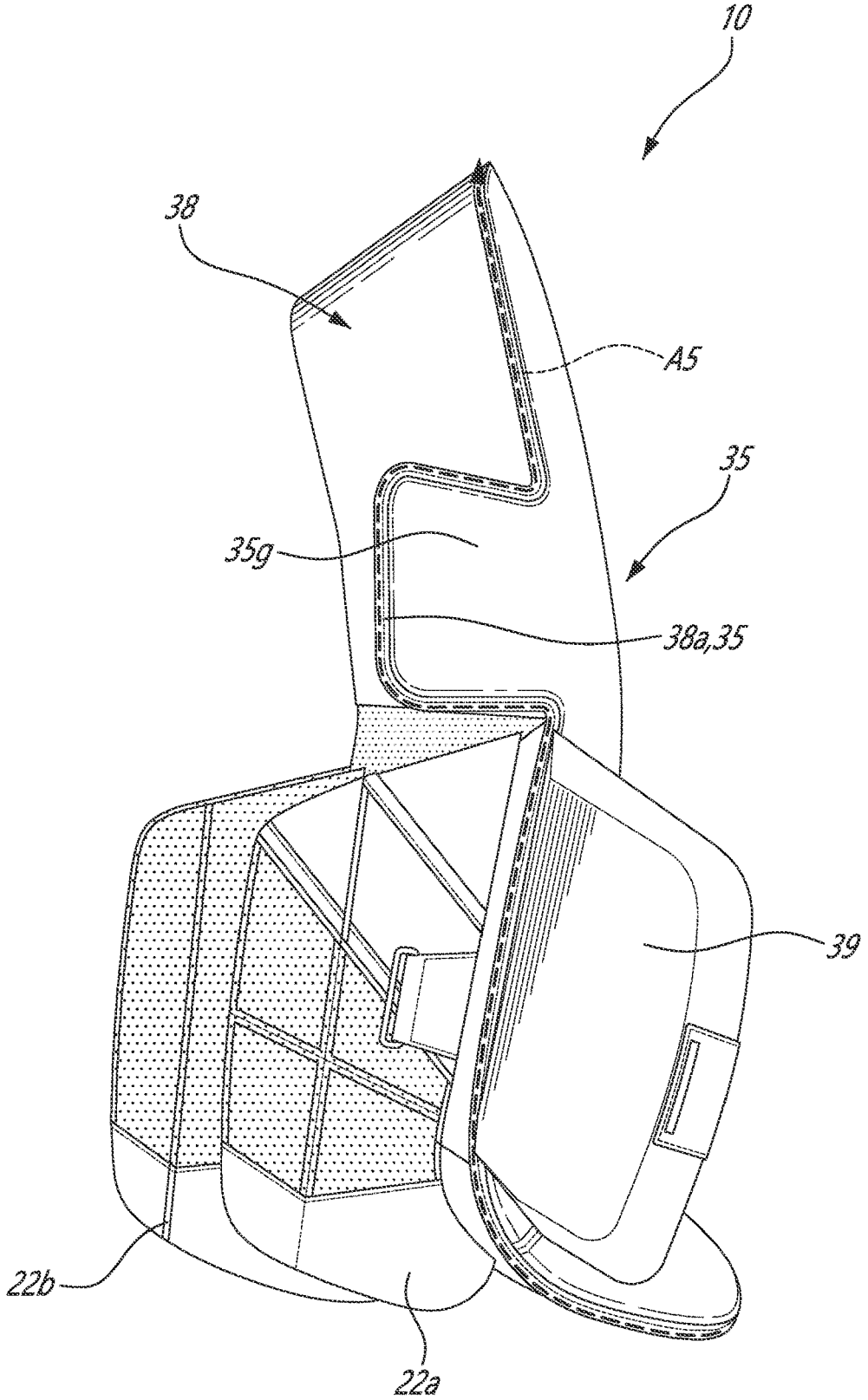
FIG. 12 is a three dimensional view of the left leg pad of FIG. 7.

Referring now to FIG. 11, the core 34 may then be inserted into the pocket of the outer shell 33 via the opening between the medial edge 38*a* of the rear section 38 and the rear edge 35 *b* of the medial section 35. The core 34 extends from a medial face 34*m* to a lateral face 341. Thus, once received inside the pocket of the outer shell 33, the medial face 34*m* of the core 34 will be facing the medial pad 35*f* of the medial section 35. The medial face 34*m* of the core 34 may abut the medial pad 35*f*. As shown in FIG. 12, the pocket of the outer shell 33 may be closed by stitching together, along arrow A5, the medial edge 38*a* of the rear section 38 and the rear edge 35*b* of the medial section 35. A stitch line thus generated extends around, as opposed to across, the knee pad 35*g* of the medial section 35. The calf wing 39 may then be pivoted to abut against the medial calf flap 22*a*. A band of fabric may be stitch to cover the rear edge 35*b* of the medial section 35 and the medial edge 38*a* of the rear section 38 for improved durability and esthetic.

It will be appreciated that, in another embodiment, the outer shell need not be inverted inside out. That is, the facing section 37 and the rear section 38 may have their lateral edges 37*c*, 38*c* stitched to the front edge 36*a* and the rear edge 36*b* of the lateral gusset section 36, and, the medial section 35 may have its front edge 35*a* stitched to the medial edge 37*b* of the facing section 37 leaving an opening at the rear edge 35*b* of the medial section 35 to insert the core 34. Once the core 34 is inserted into the outer shell 33, the rear edge 35*b* may be stitched to the medial edge 38*a* of the rear section 38 to close the pocket to enclose the core 34. A band of fabric may then be stitched all around a perimeter of the leg pad 10 for improved durability and esthetic.

Some variations in the order of the manufacturing steps described above are contemplated without departing from the scope of the present disclosure.

As can be seen therefore, the examples described above and illustrated are intended to be exemplary only. The scope is indicated by the appended claims.

The invention claimed is:

1. A hockey goalkeeper leg pad having a top end configured to be located proximate a knee of a wearer when worn by the wearer and a bottom end configured to be located proximate a foot of the wearer when worn by the wearer, the hockey goalkeeper leg pad comprising:

an outer shell consisting of a facing section configured for facing away from the wearer, a rear section configured for facing the wearer, a lateral section, and a medial section, the medial section located inwardly of the lateral section when worn by the wearer, the facing, rear, lateral, and medial sections interconnected to form a pocket defined within the outer shell;

a core padding received within the pocket of the outer shell, the core padding extending from a lateral face of the core padding to a medial face of the core padding opposite to the lateral face;

wherein the medial section is a medial pad separate from the core padding, the medial pad disposed adjacent and overlapping the medial face of the core padding, the medial pad having:

a longitudinal pad extending longitudinally between the top end and the bottom end in a vertical direction, and a knee pad configured to overlap a medial side of the knee of the wearer, the knee pad monolithically protruding rearwardly from the longitudinal pad in a transverse direction that is transverse to the vertical direction, a width of the medial pad, in the transverse direction, extending uninterrupted from a front edge of the longitudinal pad to a rear edge of the knee pad, wherein the medial pad is free of a hinge connection at an intersection between the knee pad and the longitudinal pad, a thickness of the medial pad at the intersection between the knee pad and the longitudinal pad is substantially equal to the thickness of the medial pad at opposite sides of the intersection, a first side of the opposite sides being on the longitudinal pad, a second side of the opposite sides being on the knee pad.

2. The hockey goalkeeper leg pad of claim 1, wherein the knee pad and the longitudinal pad are free of a stitch line therebetween.

3. The hockey goalkeeper leg pad of claim 1, wherein a thickness of the medial pad in a direction transverse to the width is uniform from the longitudinal pad to the knee pad across the intersection therebetween.

4. The hockey goalkeeper leg pad of claim 1, wherein a medial edge of the rear section is stitched to a rear edge of the medial section along a stitch line, the stitch line extending around the knee pad.

5. The hockey goalkeeper leg pad of claim 4, wherein the medial section of the outer shell is free of direct connection to the rear section of the outer shell along an intersection between the longitudinal pad and the knee pad.

6. The hockey goalkeeper leg pad of claim 1, wherein the pocket has a core volume receiving the core padding, a knee pad volume receiving the knee pad, and a longitudinal pad volume receiving the longitudinal pad, the knee pad volume uninterruptedly communicating with the longitudinal pad volume for receiving a monolithic body defining the knee pad and the longitudinal pad.

7. The hockey goalkeeper leg pad of claim 1, wherein the facing section has a front lateral edge, the rear section has a rear lateral edge, the lateral section has opposed front and rear lateral edges each secured to a respective one of the front lateral edge and the rear lateral edge via one or more stitch lines, the front lateral edge, the rear lateral edge, and the opposed front and rear lateral edges located inside the pocket.

8. The hockey goalkeeper leg pad of claim 7, wherein the facing section has a front medial edge, the rear section has a rear medial edge, and the medial section has opposed front and rear medial edges each secured to a respective one of the front medial edge and the rear medial edge, the front medial edge, the rear medial edge, and the opposed front and rear medial edges located outside the pocket.

9. The hockey goalkeeper leg pad of claim 8, wherein the opposed front and rear medial edges follow a contour of the knee pad.

10. A hockey goalkeeper leg pad having a top end configured to be located proximate a knee of a wearer when worn by the wearer and a bottom end configured to be located proximate a foot of the wearer when worn by the wearer, the hockey goalkeeper leg pad comprising:

an outer shell consisting of a plurality of sections including a facing section configured for facing away from the wearer, a lateral section, a medial section, and a rear section configured for facing toward the wearer, the plurality of sections being interconnected to define a pocket sized for receiving a core padding of the hockey goalkeeper leg pad; and a core padding received within the pocket of the outer shell, the core padding extending from a lateral face of the core padding to a medial face of the core padding opposite to the lateral face;

wherein the medial section is a medial pad the medial pad overlapping the medial face of the core padding and having a longitudinal pad extending longitudinally between the top end and the bottom end in a vertical direction, and a knee pad monolithic with the longitudinal pad and protruding therefrom in a transverse direction that is transverse to the vertical direction, wherein the pocket has a core volume sized for receiving the core padding, a knee pad volume receiving the knee pad, and a longitudinal pad volume receiving the longitudinal pad, the knee pad volume uninterruptedly communicating with the longitudinal pad volume for receiving a monolithic body defining the knee pad and the longitudinal pad, a thickness of the medial pad within the knee pad volume and the longitudinal pad volume being substantially equal to a thickness of the medial pad at an intersection between the knee pad volume and the longitudinal pad volume.

11. The hockey goalkeeper leg pad of claim 10, wherein the knee pad and the longitudinal pad are free of a stitch line therebetween.

* * * * *